US010370874B2

(12) United States Patent
Rosales et al.

(10) Patent No.: US 10,370,874 B2
(45) Date of Patent: Aug. 6, 2019

(54) MOTOR VEHICLE LOCK ARRANGEMENT

(71) Applicant: Brose Schliesssysteme GmbH & Co. KG, Wuppertal (DE)

(72) Inventors: David Rosales, Rochester Hills, MI (US); Stepan Hanke, Lake Orion, MI (US); Nathalie Westhoff, Rochester Hills, MI (US)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 415 days.

(21) Appl. No.: 15/075,658

(22) Filed: Mar. 21, 2016

(65) Prior Publication Data

US 2017/0074003 A1 Mar. 16, 2017

Related U.S. Application Data

(60) Provisional application No. 62/218,165, filed on Sep. 14, 2015.

(51) Int. Cl.
*E05B 77/04* (2014.01)
*E05B 79/10* (2014.01)
*E05B 85/24* (2014.01)

(52) U.S. Cl.
CPC ..... *E05B 77/04* (2013.01); *E05B 79/10* (2013.01); *E05B 85/243* (2013.01)

(58) Field of Classification Search
CPC ..... E05B 77/04
USPC ..... 292/336.3, 194, 195, 216
See application file for complete search history.

(56) References Cited

U.S. PATENT DOCUMENTS

| | | | | |
|---|---|---|---|---|
| 5,492,379 | A * | 2/1996 | Staser | E05B 79/12 292/336.3 |
| 6,880,867 | B2 * | 4/2005 | Schoen | E05B 77/06 292/216 |
| 6,942,260 | B2 * | 9/2005 | Bucker | E05B 77/02 292/336.3 |
| 7,648,192 | B2 * | 1/2010 | Herline | E05B 77/04 292/92 |
| 8,360,486 | B2 * | 1/2013 | Gschweng | E05B 17/0062 292/336.3 |
| 8,701,817 | B2 * | 4/2014 | Schoen | E05B 77/04 180/281 |
| 2010/0019512 | A1 * | 1/2010 | Gschweng | E05B 53/00 292/217 |

(Continued)

FOREIGN PATENT DOCUMENTS

| | | | | |
|---|---|---|---|---|
| FR | 2970680 | A1 * | 7/2012 | E05B 77/04 |
| GB | 2361675 | A * | 10/2001 | E05B 77/04 |

*Primary Examiner* — Carlos Lugo
(74) *Attorney, Agent, or Firm* — Pauly, DeVries Smith & Deffner LLC

(57) ABSTRACT

A vehicle lock arrangement for a vehicle door, having a vehicle lock with a lock element such as a pawl, at least one actuation lever to deflect the lock element and thereby to open the vehicle lock, and at least one elongate force transmission element, which couples the at least one actuation lever to a respective door handle. At least one crash detection element in the form of an elongate force transmission element for the transmission of pulling forces is provided, which in the installed state extends through a part of the motor vehicle door and is coupled to a control mechanism, which control mechanism may be switched to a disabling state.

16 Claims, 3 Drawing Sheets

(56) References Cited

U.S. PATENT DOCUMENTS

| | | | | |
|---|---|---|---|---|
| 2011/0062747 | A1* | 3/2011 | Teramoto | E05B 77/04<br>296/146.1 |
| 2014/0284940 | A1 | 9/2014 | Rosales et al. | |

* cited by examiner

MOTOR VEHICLE LOCK ARRANGEMENT

CLAIM OF PRIORITY

This application claims the benefit of U.S. Provisional Application No. 62/218,165, filed Sep. 14, 2015, the content of which is herein incorporated by reference in its entirety.

FIELD OF THE TECHNOLOGY

The application is directed to a motor vehicle lock arrangement as well as to a motor vehicle door.

BACKGROUND

The motor vehicle lock arrangement is assigned to a motor vehicle door, which normally comprises an inner door shell and an outer door shell. The expression "motor vehicle door" is to be understood in a broad sense. It includes in particular side doors, back doors, lift gates, trunk lids or engine hoods. Such a motor vehicle door may generally be designed as a sliding door as well.

The known motor vehicle lock arrangement (US 2014/0284940 A1), which is to be considered closest state of the art, comprises a motor vehicle lock with a lock element in the form of a pawl, which is assigned a catch. The catch is interacting with a lock striker in order to hold the motor vehicle door in its closed position.

The known motor vehicle lock comprises an actuation lever to deflect the lock element and thereby to open the motor vehicle lock. The actuation lever is coupled to an outer door handle via an elongate force transmission element in the form of a Bowden cable.

The known motor vehicle lock arrangement provides an exceptional crash safety in case the motor vehicle door is being deformed by a crash impact. For this the motor vehicle lock in its immediate vicinity comprises a crash element that may be deflected by the crash induced deformation of the motor vehicle door.

It has been found that a considerable risk during a side crash goes back on the Bowden cable between the outer door handle and the motor vehicle lock. For example, during a side crash, the Bowden cable may be deflected laterally to its extension such that it transmits a pulling force to the motor vehicle lock, leading to deflection of the pawl and as a result to opening of the motor vehicle lock. Also it has been found that during a side crash the inner cable and the outer sheath of the Bowden cable may get jammed during a side crash such that the Bowden cable only functions as a simple rope further increasing the risk of undesired deflection of the pawl.

As a result the use of an elongated force transmission element between the door handle and the actuation lever imposes a challenge to the known motor vehicle lock arrangement regarding its crash safety.

SUMMARY

It is an object of the invention to improve the known motor vehicle lock arrangement such that its crash safety in view of a side crash is improved.

The above noted object is solved for a motor vehicle lock arrangement as described herein.

The basic idea according to the invention is to provide a crash detection element which in the event of a crash induced deformation of the motor vehicle door transmits pulling forces to a control mechanism, which control mechanism disables the respective door handle. The fact that only pulling forces are needed to disable the door handle allows a simple construction of the crash detection element, in particular by using a simple cable or the like. Further it is possible to have the crash detection element extend through the motor vehicle door along a route, which is advantageous in view of the deformation to be expected during a side crash. A side crash is presently to be considered a crash with an impact that is directed basically perpendicularly to the outer door shell of the motor vehicle door.

In further detail, according to the proposed solution, in addition to the at least one elongate force transmission element assigned to the at least one actuation lever, at least one crash detection element in the form of another elongate force transmission element is provided, which in the installed state extends through a part of the motor vehicle door and is coupled to a control mechanism, which control mechanism may be switched to a disabling state, in which at least one actuation lever is disabled with respect to deflecting the lock element. The crash detection element, by following a crash induced deformation of the motor vehicle door, may be deflected, which crash induced deflection causes the transmission of pulling forces via the crash detection element to the control mechanism and thereby switches the control mechanism into the disabling state. Switching the control mechanism into the disabling state corresponds to the disabling of the respective door handle.

An embodiment is directed to the integration of the control mechanism into the motor vehicle lock. The best integration may be achieved by a solution, in which the control mechanism provides a part of the lock mechanism of the motor vehicle lock, which lock mechanism realizes the different lock states of the motor vehicle lock during normal operation.

Some embodiments include routing of the crash detection element such that the probability of reacting to a side crash by disabling the respective door handle is maximized. This is done by arranging the crash detection element along a route which most likely is being deformed during a side crash.

Various embodiments of the crash detection element itself. Due to the fact that the proposed solution only relies on the transmission of pulling forces by the crash detection element, the realization of the crash detection element becomes particularly simple. Furthermore the flexibility in terms of bendability of the crash detection element is advantageous in view of the above noted, optimized routing of the crash detection element.

Some embodiments focus on a maximum in crash safety regarding a force transmission element between an actuation lever and a door handle, which is to be protected in the sense that undesired actuation of this force transmission element is to be prevented. By routing the crash detection element along the force transmission element to be protected it is ensured that the crash detection element experiences basically the same deflection as the force transmission element to be protected. By providing that during the crash the crash detection element switches the control mechanism earlier than the force transmission element to be protected actuates the respective actuation lever, an undesired, crash induces deflection of the lock element is safely prevented. One possibility for ensuring the above noted synchronization is to provide the crash detection element of a shorter length than the force transmission element to be protected.

In a further embodiment, the crash detection element, in the normal operating state, is pretensioned against the control mechanism. The arrangement is such that a crash induced drop of the pretension leads to switching of the control mechanism into the disabling state, disabling the respective door handle.

An embodiment is directed to a motor vehicle door as such, which comprises an inner door shell and an outer door shell as well as a motor vehicle lock arrangement according to the above. In an embodiment the motor vehicle lock arrangement is at least partly arranged within the motor vehicle door. Reference is made to all explanations given with respect to the proposed motor vehicle lock arrangement.

In an embodiment, provided is a motor vehicle lock arrangement for a motor vehicle door, wherein a motor vehicle lock with a lock element such as a pawl, which is assigned to a catch, is provided, wherein the motor vehicle lock comprises at least one actuation lever to deflect the lock element and thereby to open the motor vehicle lock, wherein at least one elongate force transmission element is provided, which couples the at least one actuation lever to a respective door handle, wherein in addition to the at least one elongate force transmission element assigned to the at least one actuation lever, at least one crash detection element in the form of an elongate force transmission element for the transmission of pulling forces is provided, which in the installed state extends through a part of the motor vehicle door and is coupled to a control mechanism, which control mechanism may be switched to a disabling state, in which at least one actuation lever is disabled with respect to the deflection of the lock element, that the crash detection element, by following a crash induced deformation of the motor vehicle door, may be deflected, which crash induced deflection causes a buildup or drop of pulling forces transmitted via the crash detection element to the control mechanism and thereby switches the control mechanism into the disabling state.

In an embodiment, in the disabling state of the control mechanism the actuation lever runs free without deflecting the lock element or is being blocked.

In an embodiment, the control mechanism is a part of the motor vehicle lock. In an embodiment, the motor vehicle lock provides a lock mechanism that may be brought into different lock states such as "unlocked" and "locked" and that the control mechanism provides part of the lock mechanism.

In an embodiment, the crash detection element is extending through the motor vehicle door along a route, which route leads through an area of higher probability of deformation induced by a side crash compared to the other possible routes of the same or shorter length.

In an embodiment, the force transmission element assigned to the crash detection element is designed for the transmission of pulling forces only.

In an embodiment, the crash detection element is a flexible, such as a limp, force transmission element for the transmission of pulling forces.

In an embodiment, the crash detection element is a cable, a rope, a belt or the like.

In an embodiment, the crash detection element is a Bowden cable with an inner cable and a cable sheath.

In an embodiment, at least part of the end of the crash detection element, which end is arranged oppositely to the motor vehicle lock, is fixed at the motor vehicle door.

In an embodiment, the cable sheath of the end of the crash detection element opposite the motor vehicle lock is fixed at the motor vehicle door.

In an embodiment, the crash detection element extends along a force transmission element assigned to an actuation lever.

In an embodiment, the force transmission element assigned to the crash detection element is shorter than the force transmission element it is extending along.

In an embodiment, the crash detection element, in the normal operating state, is pretensioned against the control mechanism and that the crash detection element, by following a crash induced deformation of the motor vehicle door, may be deflected, which crash induced deflection causes a drop in the pretension of the crash detection element and thereby switches the control mechanism into the disabling state.

In an embodiment, at least two crash detection elements are provided, which are extending through the motor vehicle door along different routes.

In an embodiment, provided is a motor vehicle door with an inner door shell and an outer door shell and a motor vehicle lock arrangement as described herein.

BRIEF DESCRIPTION OF THE FIGURES

In the following, the invention is described with reference to the drawings. In the drawings

DETAILED DESCRIPTION

Figure 1:
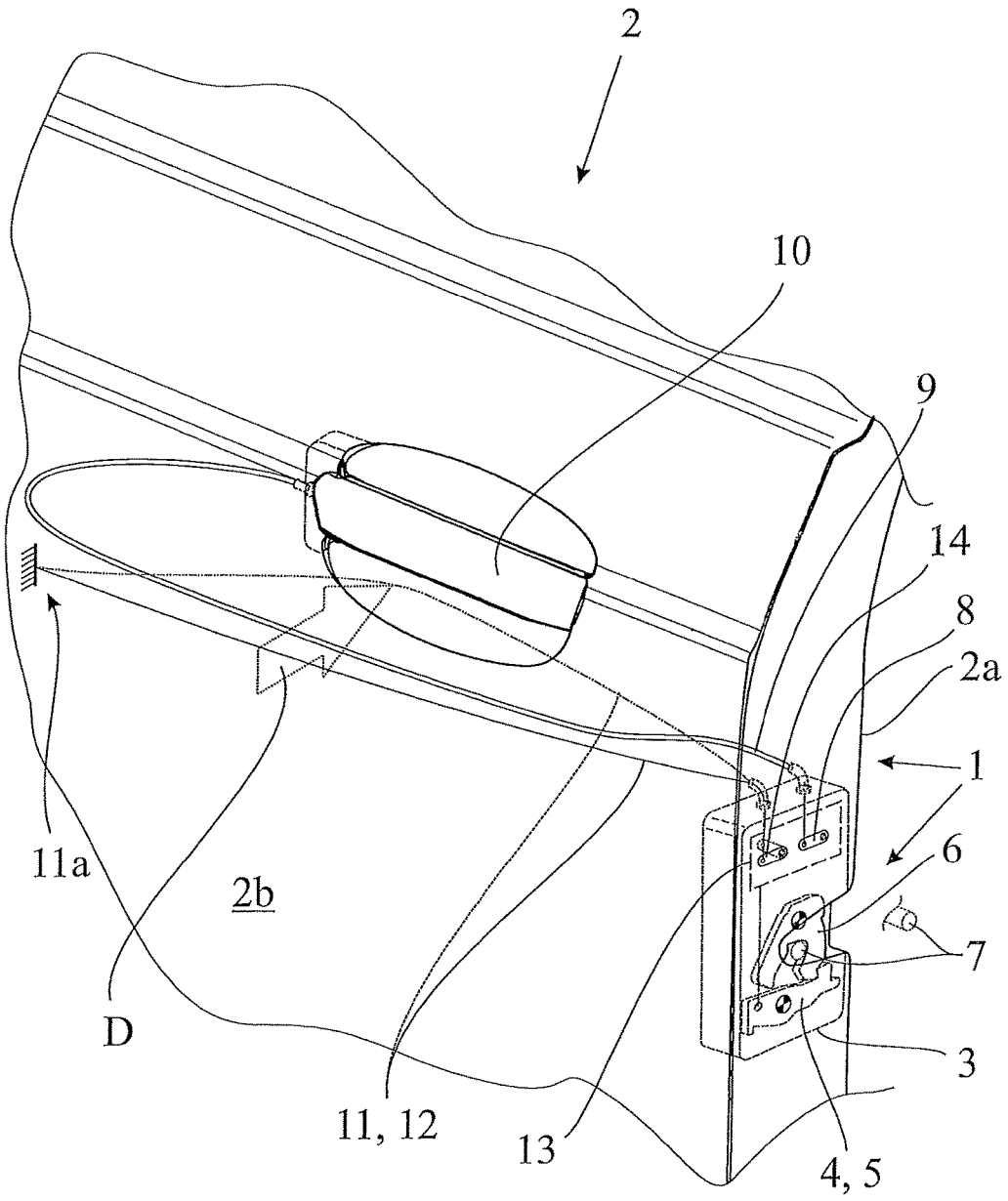
FIG. 1 is a proposed motor vehicle door with a motor vehicle lock arrangement according to a first embodiment.

The proposed motor vehicle lock arrangement 1 is assigned to a motor vehicle door 2 as may be seen in FIG. 1. This motor vehicle lock arrangement 1 comprises a motor vehicle lock 3, which comprises a lock element 4. The deflection of the lock element 4 leads to opening the motor vehicle lock 3 and thereby the opening of the motor vehicle door 2. Here the lock element 4 is a pawl 5, which is assigned to a catch 6, which catch 6 may be brought into holding engagement with a lock striker 7 as is generally known from the state of the art. For the realization of the lock element 4 different alternatives exists, which may work with or without a catch 6.

The motor vehicle lock 3 comprises at least one actuation lever 8, which actuation may deflect the lock element 4 depending on the lock state of the motor vehicle lock 3. The deflection of the lock element 4 leads to opening of the motor vehicle lock 3 as noted above. In FIG. 1, an elongate force transmission element 9, here a Bowden cable, is provided, which couples the actuation lever 8 to the door handle 10, which in FIG. 1 is the outer door handle.

It may be pointed out that in addition to the above noted outer actuation lever 8, which is assigned to the outer door handle 10, an inner actuation lever may be provided, which is assigned to an inner door handle, wherein the inner actuation lever and the inner door handle are coupled by another elongate force transmission element, here a Bowden cable as well, (not shown). All explanations given for the outer actuation lever 8, the outer door handle 10 and the respective force transmission element 9 are fully applicable to the inner actuation lever, the inner door handle and the respective force transmission element.

According to the proposed solution, in addition to the at least one elongate force transmission element 9 assigned to the at least one actuation lever 8, at least one crash detection element 11 in the form of an elongate force transmission element 12 for the transmission of pulling forces is provided, which in the installed state extends through a part of the motor vehicle door 2 as shown in FIG. 1. The crash detection element 11 is coupled to a control mechanism 13, which control mechanism 13 may be switched between an enabling state and a disabling state. The control mechanism 13 is coupled to the at least one actuation lever 8 on the one hand and to the lock element 4 on the other hand such that in the disabling state, the at least one actuation lever 8 is disabled with respect to the deflection of the lock element 4. This means in general, that the actuation of the actuation lever 8 does not lead to deflection of the lock element 4. In the enabling state, the control mechanism 13 does not hinder the actuation lever 8 from deflecting the lock element 4. Depending on the application, the disabling state may regard the outer actuation lever 8 and/or the inner actuation lever and accordingly the outer door handle 10 and/or the inner door handle.

Figure 2:
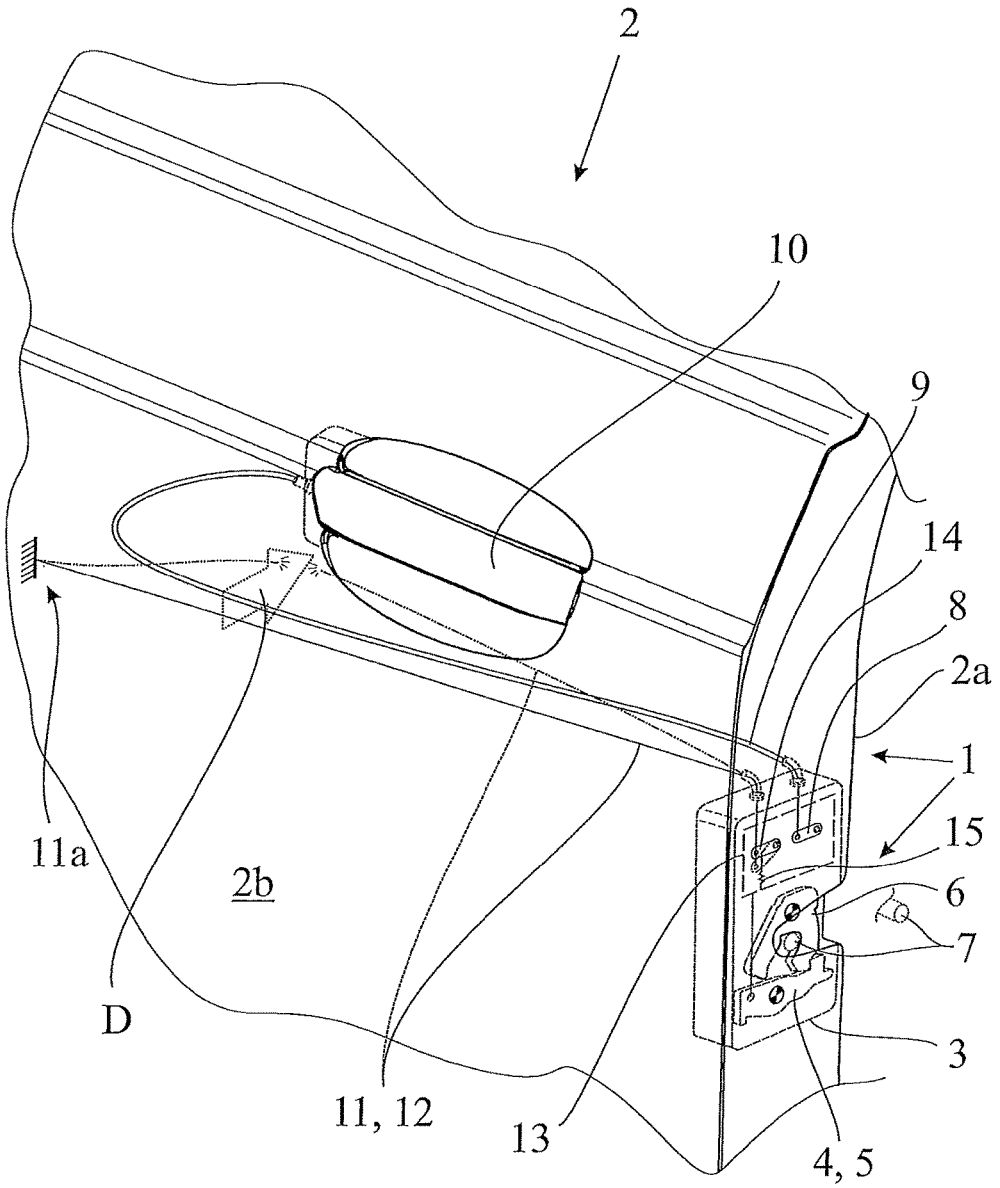
FIG. 2 is a proposed motor vehicle door with a motor vehicle lock arrangement according to a second embodiment.

For the above, the control mechanism 13 comprises a control lever 14, which is coupled correspondingly to the force transmission element 12 assigned to the crash detection element 11 as shown in FIG. 2.

Figure 3A:
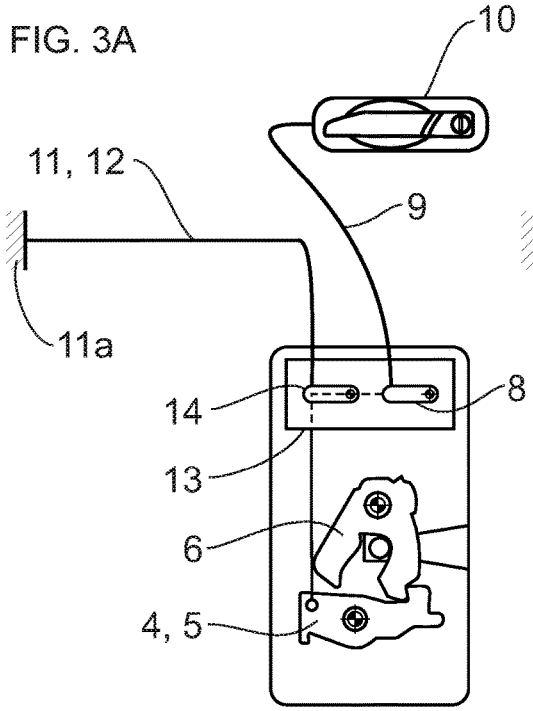
FIG. 3A illustrates a motor vehicle lock arrangement in a normal state with an enabled but unactuated actuation lever, according to an embodiment.
Figure 3B:
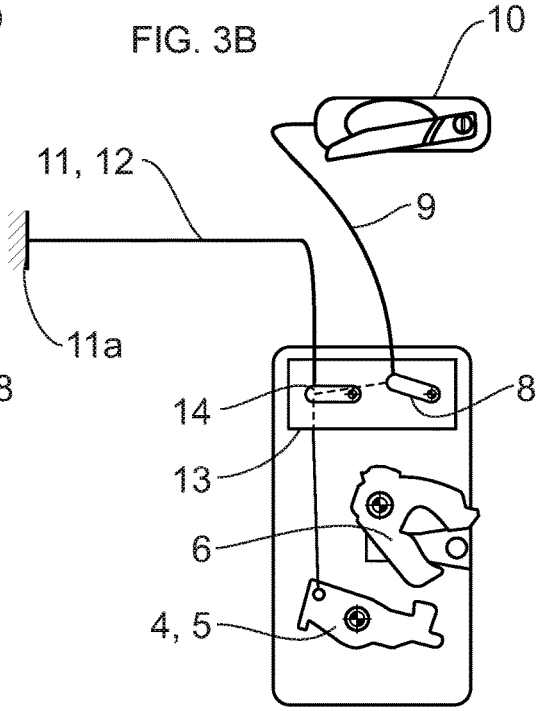
FIG. 3B illustrates a motor vehicle lock arrangement in a normal state with an enabled and actuated actuation lever, according to an embodiment.

FIGS. 3A and 3B schematically illustrate a motor vehicle lock arrangement as described above according to an embodiment. The lock arrangement is in the enabling state in which the control mechanism 13 (e.g., via the control lever 14) enables the actuation lever 8 to deflect the lock element 4. In FIG. 3A the actuation lever 8 is enabled but not actuated. FIG. 3B illustrates how the actuation of the door handle 10 correspondingly actuates the actuation lever 8, which in the enabling state then deflects the lock element 4.

It is of particular importance for the proposed solution that the crash detection element 11, by following a crash induced deformation D of the motor vehicle door 2, may be deflected, which crash induced deflection causes a buildup or drop of pulling forces transmitted via the crash detection element 11 to the control mechanism 13 and thereby switches the control mechanism 13 into the disabling state. The crash induced deformation of the motor vehicle door 2 is only roughly indicated by arrow D.

In Figs. 1 and 2, only the crash detection element 11 is shown in its deflected state in dotted lines as an example. In FIG. 1 the crash induced deflection of the crash detection element 11 causes a buildup of pulling forces which lead to the control mechanism 13 switching into the disabling state. In FIG. 2, however, the crash induced deflection causes a drop of pulling forces, again switching the control mechanism 13 into the disabling state.

Figure 3C:
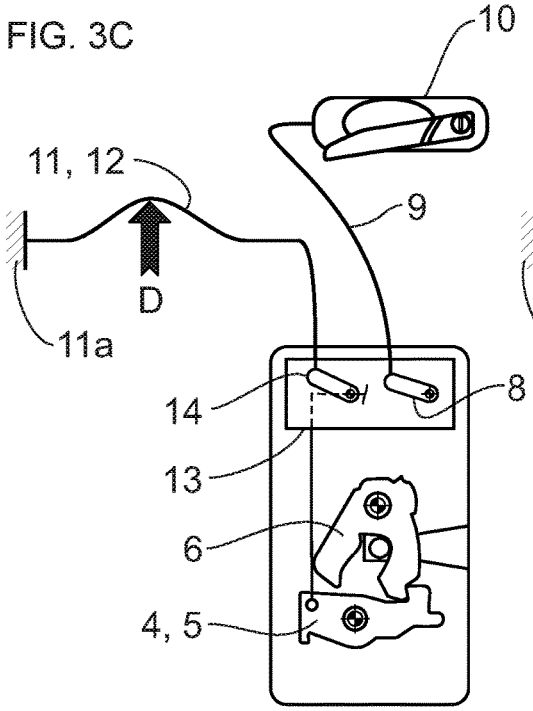
FIG. 3C illustrates the motor vehicle lock arrangement according to FIG. 1 in a crash state according to an embodiment.

FIG. 3C schematically depicts the lock arrangement according to FIG. 1 in the disabling state according to an embodiment. The crash induced deformation indicated by arrow D causes a buildup of pulling forces that are transmitted to the control lever 14 by the crash detection element 11. The buildup of pulling forces causes the control lever 14 to switch the control mechanism 13 into the disabling state, thus disabling the ability of the actuation lever 8 to deflect the lock element 4.

Figure 3D:
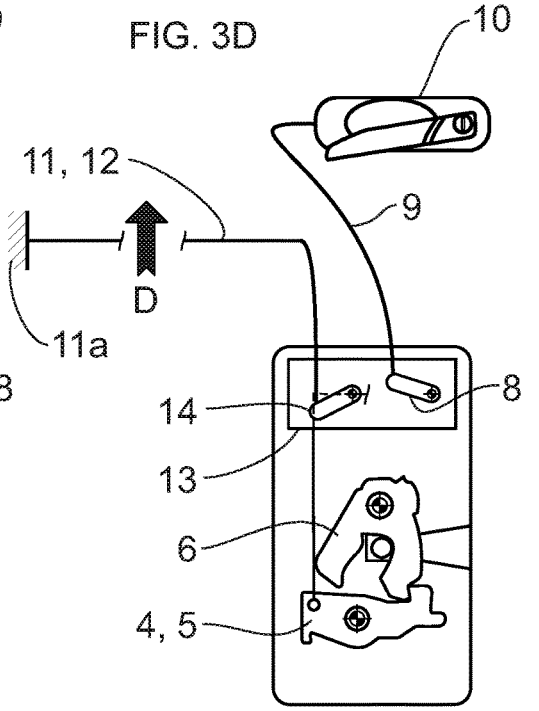
FIG. 3D illustrates the motor vehicle lock arrangement according to FIG. 2 in a crash state according to an embodiment.

FIG. 3D schematically depicts the lock arrangement according to FIG. 2 in the disabling state according to an embodiment. The crash induced deformation indicated by arrow D causes a drop of pulling forces that is transmitted to the control lever 14 by the crash detection element 11. As shown in FIG. 3D, in some cases the induced deformation leads to a break in the crash detection element, which in turn causes the drop of pulling forces. The drop of pulling forces causes the control lever 14 to switch the control mechanism 13 into the disabling state, thus disabling the ability of the actuation lever 8 to deflect the lock element 4.

The disabling state of the control mechanism 13 may be realized in different ways. According to an embodiment, in the disabling state of the control mechanism 13 the actuation lever 8, when being actuated, runs free without deflecting the lock element 4. In another embodiment, in the disabling state of the control mechanism 13, the actuation lever 8 is being blocked. In both cases it is not possible to deflect the lock element 4 by trying to actuate the actuation lever 8 via the door handle 10. In the first noted alternative for realizing the control mechanism 13 it is worth mentioning that the control mechanism 13 is nothing else but a switchable coupling mechanism. Such a coupling mechanism can be used for realizing the different lock states of the motor vehicle lock 3, as will be explained later.

The control mechanism 13 may be a module which is realized separately from the motor vehicle lock 3. Here, however, the control mechanism 13 is a part of the motor vehicle lock 3, which leads to a particularly compact structure. In and embodiment the control mechanism 13 is even used for providing various lock functions of the motor vehicle lock 3 during normal operation. In further detail the motor vehicle lock 3 provides a lock mechanism that may be brought into different lock states such as "unlocked" and "locked", wherein the control mechanism 13 provides part of the lock mechanism.

Generally, the lock state "unlocked" means that the motor vehicle lock 3 may be opened by the outer door handle 10 as well as the inner door handle. The lock state "locked" means that the motor vehicle lock 3 may be opened by the inner door handle, but not by the outer door handle 10. Here it becomes apparent that the control mechanism 13 may well be used for realizing the lock state "locked" by letting at least the outer actuation lever 8 run free as noted above.

The lock mechanism may include a so called "override function", which guarantees, that starting from the lock state "locked" an actuation of the inner actuation lever causes the lock mechanism to enter the lock state "unlocked". In this case it is especially advantageous to have the control mechanism 13 hold its disabling state during a side crash, such that a subsequent, crash induced actuation of the inner actuation lever does not lead to unlocking the lock mechanism respective to moving the control mechanism 13 into its enabling state.

It has been pointed out already that due to the crash detection element 11 only having to transmit pulling forces leads to a simple realization of the crash detection element 11. In particular it is possible to realize the crash detection element 11 as a flexible, in particular bendable, force transmission element 12. This allows the crash detection element 11 to be routed through the motor vehicle door 2 in various ways. In this context the crash detection element 11 can be extending through the motor vehicle door 12 along a route, which route leads through an area of higher probability of deformation D induced by a side crash compared to the other possible routes of the same or shorter length of the crash detection element 11. According to this embodiment, the routing of the crash detection element 11 is optimized such that its crash induced deflection during a side crash is maximized. With this the probability of the crash detection element 11 disabling the actuation lever 8 before its crash induced, undesired actuation is maximized.

Generally the force transmission element 12 assigned to the crash detection element may be designed to transmit not only pulling forces, but also pushing forces. However, here the force transmission element 12 assigned to the crash detection element 11 is designed for the transmission of pulling forces only. This makes the crash detection element 11 easy to realize, as noted above. With the above a realization of the crash detection element 11 is a flexible, such as a limp, element for the transmission of pulling forces. Accordingly, the crash detection element 11 may well be a cable, a rope, a belt or the like. Here the crash detection element 11 is a simple cable as shown in the drawings.

However, the crash detection element 11 can be a Bowden cable with an inner cable and a cable sheath. This is advantageous as the force transmission element 9 between the actuation lever 8 and the door handle 10 can be a Bowden cable as well. With the force transmission element 12 assigned to the crash detection element 11 and the force transmission element 9 assigned to the actuation lever 8 each being a Bowden cable, they both have the same crash characteristics which may be advantageous for an optimized design of the crash detection element 11 as will be explained later.

The crash detection element 11, in particular the force transmission element 12, may be made of steel, plastic or a textile which is of necessary strength. In case of realizing the crash detection element 11, in particular the force transmission element 12, as a cable, it is possible to apply a steel cable.

In various embodiments, at least part of the end 11*a* of the crash detection element 11, which end 11*a* is arranged oppositely to the motor vehicle lock 3, is fixed at the motor vehicle door 2. This fixture at the motor vehicle door 2 provides counter support against the pulling forces to be transmitted to the control mechanism 13. In the case of the realization of the crash detection element 11 as a Bowden cable, in some embodiments only the cable sheath of the end of the crash detection element 11 opposite the motor vehicle lock 3 is fixed at the motor vehicle door 2. This corresponds to the fixture of the Bowden cable 9 assigned to the actuation lever 8.

In order for the crash detection element 11 to have similar crash characteristics as the force transmission element 9 assigned to the actuation lever 8 it is proposed that the crash detection element 11, namely the force transmission element 12 assigned to the crash detection element 11, extends along the force transmission element 9 assigned to the actuation lever 8. In various embodiments, the two force transmission elements 9, 12 are at least partly distanced from each other by less than 40 mm, such as 20 mm.

In order to guarantee that switching the control mechanism 13 into the disabling state in good time as noted above, one possibility is to design the crash detection element 11 of shorter length than the force transmission element 9 it is extending along. Another possibility to ensure this synchronization is to synchronize the respective actuation strokes of the actuation lever 8 on the one hand and of the control lever 14 on the other hand.

As shown in FIG. 2, the crash induced deflection of the crash detection element 11 leads to a buildup of pulling forces which are being transmitted by the crash detection element 11. In the embodiment according to FIG. 2, the crash induced deflection of the crash detection element 11 causes a drop in the pulling forces to be transmitted by the crash detection element 11 and thereby to switching of the control mechanism 13 into the disabling state. In further detail, the crash detection element 11, in the normal operating state, is pretensioned against the control mechanism 13, here against the control lever 14, wherein the crash detection element 11, by following a crash induced deformation D of the motor vehicle door 2, may be deflected as shown in FIG. 2 in dotted lines. This crash induced deflection causes a drop in the pretension of the crash detection element 11 and therewith switches the control mechanism 13 into the disabling state. For this, the control lever 14 is pretensioned accordingly by a spring arrangement 15, which leads to an automatic switching of the control mechanism 13 into the disabling state, when the pretension of the crash detection element 11 has dropped accordingly.

FIG. 2 shows that the crash induced deflection of the crash detection element 11 leads to a breakage of the crash detection element 11 and thereby a drop in the pulling forces transmitted. However, it may also be provided that a crash situation only leads to the ends of the crash detection element 11 coming closer together, thereby reducing the pretension of the crash detection element 11 with the result as noted above.

The embodiments shown in the drawings each only comprise one single crash detection element 11. However, the proposed solution may be realized with multiple crash detection elements 11, which allows to route the multiple crash detection elements 11 differently. With this, various areas of the motor vehicle door 2 may be monitored by the crash detection element 11 as explained above. All explanations given for the single crash detection element 11 are fully applicable to all other crash detection elements 11 possibly provided.

According to another teaching, the motor vehicle door 2, which comprises an inner shell 2*a* and an outer shell 2*b* and which also comprises a motor vehicle lock arrangement 1 according to the first teaching is claimed as such. All explanations given for the proposed motor vehicle lock arrangement 1 are fully applicable to the claimed motor vehicle door 2.

The invention claimed is:

1. A motor vehicle lock arrangement for a motor vehicle door, wherein a motor vehicle lock with a lock element such as a pawl, which is assigned to a catch, is provided, wherein the motor vehicle lock comprises an actuation lever to deflect the lock element and thereby to open the motor vehicle lock, wherein a first elongate force transmission element is provided, which couples the actuation lever to a respective door handle, wherein in addition to the first elongate force transmission element assigned to the actuation lever, and at least one crash detection element in the form of a flexible second elongate force transmission element for the transmission of pulling forces is provided, which in an installed state extends through a part of the motor vehicle door and is coupled to a control mechanism, which control mechanism may be switched to a disabling state, in which the actuation lever is disabled with respect to the deflection of the lock element, wherein the crash detection element, by following a crash induced deformation of the motor vehicle door, is 1) deflected, wherein the crash induced deflection of the crash detection element causes a buildup of pulling forces that is transmitted via the crash detection element to the control mechanism thereby switching the control mechanism into the disabling state, or
2) broken, wherein the crash induced breaking of the crash detection element causes a drop of pulling forces that is transmitted via the crash detection element to the control mechanism, thereby switching the control mechanism into the disabling state, or
3) deflected, such that the ends of the crash detection element come closer together, wherein the crash induced deflection of the crash detection element causes a drop of pulling forces that is transmitted via the crash detection element to the control mechanism, thereby switching the control mechanism into the disabling state.

2. The motor vehicle lock arrangement according to claim 1, wherein in the disabling state of the control mechanism the actuation lever runs free without deflecting the lock element or is being blocked.

3. The motor vehicle lock arrangement according to claim 1, wherein the control mechanism is a part of the motor vehicle lock.

4. The motor vehicle lock arrangement according to claim 3, wherein the motor vehicle lock provides a lock mechanism that may be brought into different lock states such as an "unlocked" state and a "locked" state, and wherein the control mechanism provides part of the lock mechanism.

5. The motor vehicle lock arrangement according to claim 1, wherein the crash detection element is extending through the motor vehicle door along a route, which route leads through an area of higher probability of deformation induced by a side crash compared to the other possible routes of the same or shorter length.

6. The motor vehicle lock arrangement according to claim 1, wherein the force transmission element assigned to the crash detection element is designed for the transmission of pulling forces only.

7. The motor vehicle lock arrangement according to claim 1, wherein the crash detection element is a cable, a rope, or a belt.

8. The motor vehicle lock arrangement according to claim 1, wherein the crash detection element is a Bowden cable with an inner cable and a cable sheath.

9. The motor vehicle lock arrangement according to claim 8, wherein the cable sheath of the end of the crash detection element opposite the motor vehicle lock is fixed at the motor vehicle door.

10. The motor vehicle lock arrangement according to claim 1, wherein at least part of the end of the crash detection element, which end is arranged oppositely to the motor vehicle lock, is fixed at the motor vehicle door.

11. The motor vehicle lock arrangement according to claim 1, wherein the crash detection element extends along the first elongate force transmission element assigned to the actuation lever.

12. The motor vehicle lock arrangement according to claim 11, wherein the second elongate force transmission element assigned to the crash detection element is shorter than the first elongate force transmission element.

13. The motor vehicle lock arrangement according to claim 1, wherein the crash detection element, in the normal operating state, is pretensioned against the control mechanism and wherein the crash detection element, by following a crash induced deformation of the motor vehicle door, is broken or deflected, wherein the crash induced breaking or deflection of the crash detection element causes a drop in the pretension of the crash detection element, thereby switching the control mechanism into the disabling state.

14. The motor vehicle lock arrangement according to claim 1, wherein at least two crash detection elements are provided, which are extending through the motor vehicle door along different routes.

15. A motor vehicle door with an inner door shell and an outer door shell and a motor vehicle lock arrangement according to any one of the preceding claims.

16. The motor vehicle lock arrangement according to claim 1, wherein the crash detection element is a limp force transmission element for the transmission of pulling forces.

* * * * *